US009286829B2

(12) United States Patent
Kim et al.

(10) Patent No.: US 9,286,829 B2
(45) Date of Patent: Mar. 15, 2016

(54) DISPLAY DEVICE

(75) Inventors: Hye-Sung Kim, Yongin (KR); Dae-Kyun Oh, Yongin (KR); Ki-Sik Park, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 327 days.

(21) Appl. No.: 13/346,974

(22) Filed: Jan. 10, 2012

(65) Prior Publication Data

US 2012/0176350 A1 Jul. 12, 2012

(30) Foreign Application Priority Data

Jan. 11, 2011 (KR) ..... 10-2011-0002804

(51) Int. Cl.

| | |
|---|---|
| ***G09G 3/36*** | (2006.01) |
| ***G09G 3/32*** | (2006.01) |
| ***G09G 5/399*** | (2006.01) |

(52) U.S. Cl.

CPC ..... *G09G 3/3233* (2013.01); *G09G 3/36* (2013.01); *G09G 5/399* (2013.01); *G09G 2330/06* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,861,879 | A * | 1/1999 | Shimizu | G09G 5/399 345/204 |
| 6,476,789 | B1 * | 11/2002 | Sakaguchi et al. | 345/100 |
| 6,697,041 | B1 * | 2/2004 | Tamai et al. | 345/100 |
| 7,551,167 | B2 * | 6/2009 | Park et al. | 345/204 |
| 7,852,328 | B2 * | 12/2010 | Park | 345/204 |
| 7,936,329 | B2 * | 5/2011 | Iriguchi et al. | 345/99 |
| 2001/0014031 | A1 * | 8/2001 | Tanaka | 365/110 |
| 2001/0021128 | A1 * | 9/2001 | Kim | 365/185.23 |
| 2002/0196225 | A1 * | 12/2002 | Fukuda | G09G 3/296 345/100 |
| 2003/0020698 | A1 * | 1/2003 | Ando | 345/204 |
| 2004/0189579 | A1 * | 9/2004 | Shimizu | 345/98 |
| 2007/0001681 | A1 * | 1/2007 | Sato | 324/457 |
| 2007/0080905 | A1 * | 4/2007 | Takahara | 345/76 |
| 2008/0284775 | A1 * | 11/2008 | Shen et al. | 345/214 |
| 2009/0109210 | A1 * | 4/2009 | Ito | 345/214 |

FOREIGN PATENT DOCUMENTS

| | | | |
|---|---|---|---|
| KR | 10-2002-0057039 | A | 7/2002 |
| KR | 10-2003-0091333 | A | 12/2003 |
| KR | 10-2005-0122606 | A | 12/2005 |
| KR | 10-2007-0068030 | A | 6/2007 |

* cited by examiner

*Primary Examiner* — Linh N Hoffner
(74) *Attorney, Agent, or Firm* — Lee & Morse, P.C.

(57) ABSTRACT

A display device includes a display panel including a display area, in which pixels are arranged, and a non-display area, a driving circuit on the non-display area of the display panel, the driving circuit being configured to drive the pixels and including a memory cell, and a delay circuit on the non-display area of the display panel, the delay circuit being connected to the memory cell of the driving circuit and being configured to delay a signal input to the memory cell of the driving circuit.

14 Claims, 9 Drawing Sheets

DISPLAY DEVICE

CROSS-REFERENCE TO RELATED APPLICATIONS

This U.S. non-provisional patent application claims priority under 35 U.S.C. §119 of Korean Patent Application No. 10-2011-0002804, filed on Jan. 11, 2011, the entire contents of which are hereby incorporated by reference.

BACKGROUND

The present disclosure herein relates to a display device.

Display devices are not only used in a television, a computer, or the like, but also widely used in small electronic devices, e.g., a mobile phone and a personal digital assistant (PDA), since display devices become lighter, slimmer, and consume less power. As display devices are used in various electronic devices and industrial fields, demands for display devices having high reliability are increasing. A display device may include a display panel and a driving circuit for driving the display panel.

SUMMARY

The present disclosure provides a highly reliable display device, and a fabricating method thereof.

The present disclosure also provides a display device including a noise compensation circuit, and a fabricating method thereof.

Embodiments of the inventive concept provide a display device including a display panel including a display area, in which pixels are arranged, and a non-display area, a driving circuit on the non-display area of the display panel, the driving circuit being configured to drive the pixels and including a memory cell, and a delay circuit on the non-display area of the display panel, the delay circuit being connected to the memory cell of the driving circuit and being configured to delay a signal input to the memory cell of the driving circuit.

The memory cell may include first and second control ports, the first and second control ports being configured to receive signals controlling programming and erasing of the memory cell, and the first control port being connected to the delay circuit.

The driving circuit may further include a first memory controller transferring a first control signal to the first control port, and a second memory controller transferring a second control signal to the second control port, the first control signal being input to the first control port through the delay circuit.

The delay circuit may include a first delay circuit connected to the first control port and a second delay circuit connected to the second control port, the first and second control signals being input to the first and second control ports through the first and second delay circuits, respectively.

The first and second control signals may be respectively input to the first and second control ports at the same time by the delay circuit.

The memory cell may further include an output port through which data of the memory cell is output, the driving circuit further comprising a switch connected to the output port and a switch controller configured to control the switch.

The display panel may further include a contact pad connected to the delay circuit, and the driving circuit further comprises a contact bump connected to the memory cell, the contact bump and the contact pad being electrically connected.

The memory cell may include a substrate with first and second well regions, the first and second well regions having first and second pickup regions, respectively, and first and second control ports connected to the first and second pickup regions, respectively.

The driving circuit further comprises a first memory controller generating signals controlling the programming and erasing of the memory cell, the contact bump includes a first contact bump connected to the first memory controller and a second contact bump connected to the first control port, and the contact pad includes first and second contact pads connected to the delay circuit, the first and second contact pads being connected to the first and second contact bumps, respectively.

The driving circuit further comprises a second memory controller generating the signals controlling the programming and erasing of the memory cell, the contact bumps further comprise a third contact bump connected to the second memory controller and a fourth contact bump connected to the second control port, the contact pads further comprise third and fourth contact pads, the delay circuit comprises a first delay circuit connected to the first and second contact pads and a second delay circuit connected to the third and fourth contact pads, and the third and fourth contact pads are connected to the third and fourth contact bumps, respectively.

The memory cell may further include first and second floating gates disposed on the first and second well regions, respectively, and connected to each other, first source and drain regions disposed in the first well region at both sides of the first floating gate, the first control port being connected to the first source region, and second source and drain regions disposed in the second well region at both sides of the second floating gate, the second control port being connected to the second source and drain regions.

Each of the pixels may include a transistor containing a gate electrode on a substrate, a gate dielectric layer, a semiconductor pattern, and source/drain electrodes, and the delay circuit may include a resistor pattern and a capacitor, wherein the resistor pattern includes a lower resistor pattern, a resistor pattern dielectric layer on the lower resistor pattern, and an upper resistor pattern on the resistor pattern dielectric layer, and wherein the capacitor includes a lower electrode, a capacitor dielectric layer on the lower electrode, and an upper electrode on the capacitor dielectric layer.

The gate electrode and the lower resistor pattern may be at a same distance from the substrate, the gate dielectric layer and the resistor pattern dielectric layer are at a same distance from the substrate, and the source/drain electrodes and the upper resistor pattern are at a same distance from the substrate.

The lower electrode and the gate electrode may be at a same distance from the substrate, the capacitor dielectric layer and the gate dielectric layer may be at a same distance from the substrate, and the upper electrode and the source/drain electrodes may be at a same distance from the substrate.

The semiconductor pattern, the lower resistor pattern, and the lower electrode may be at a same distance from the substrate, the gate dielectric layer, the resistor pattern dielectric layer, and the capacitor dielectric layer may be at a same distance from the substrate, and the gate electrode, the upper resistor pattern, and the upper electrode may be at a same distance from the substrate.

The lower resistor pattern may include first and second lower resistor patterns spaced apart from each other, the upper resistor pattern including a first upper resistor pattern penetrating the resistor pattern dielectric layer to be connected to one end of the first lower resistor pattern, a second upper resistor pattern penetrating the resistor pattern dielectric layer to be connected to the other end of the first lower resistor pattern and one end of the second lower resistor pattern, and a third upper resistor pattern penetrating the resistor pattern dielectric layer to be connected to the other end of the second lower resistor pattern.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
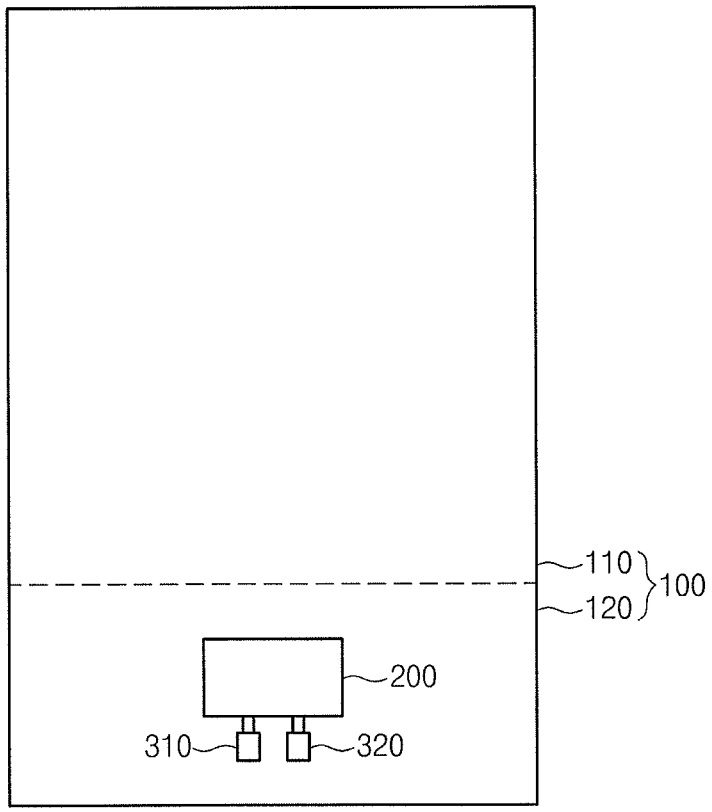
FIG. 1 is a plan view illustrating a display device according to an embodiment.

Features and advantages of example embodiments will be better understood from the following description of preferred embodiments taken in conjunction with the accompanying drawings. Example embodiments may, however, be embodied in different forms and should not be construed as limited to the embodiments set forth herein. Rather, these embodiments are provided so that this disclosure will be thorough and complete, and will fully convey the scope of the present invention to those skilled in the art.

In the specification, it will be understood that when a layer (or element) is referred to as being 'on' another layer (or element) or substrate, it can be directly on the other layer (or element or substrate), or intervening layers (or elements) may also be present. In the drawings, the dimensions of layers (or elements) and regions are exaggerated for clarity of illustration. Also, though terms like a first, a second, and a third are used to describe various regions and layers (or elements) in various embodiments, the regions and the layers are not limited to these terms. These terms are used only to discriminate one region or layer (or element) from another region or layer (or element). Therefore, a layer referred to as a first layer in one embodiment can be referred to as a second layer in another embodiment. An embodiment described and exemplified herein includes a complementary embodiment thereof. As used herein, the term 'and/or' includes any and all combinations of one or more of the associated listed items. Like reference numerals refer to like elements throughout.

Figure 2A:
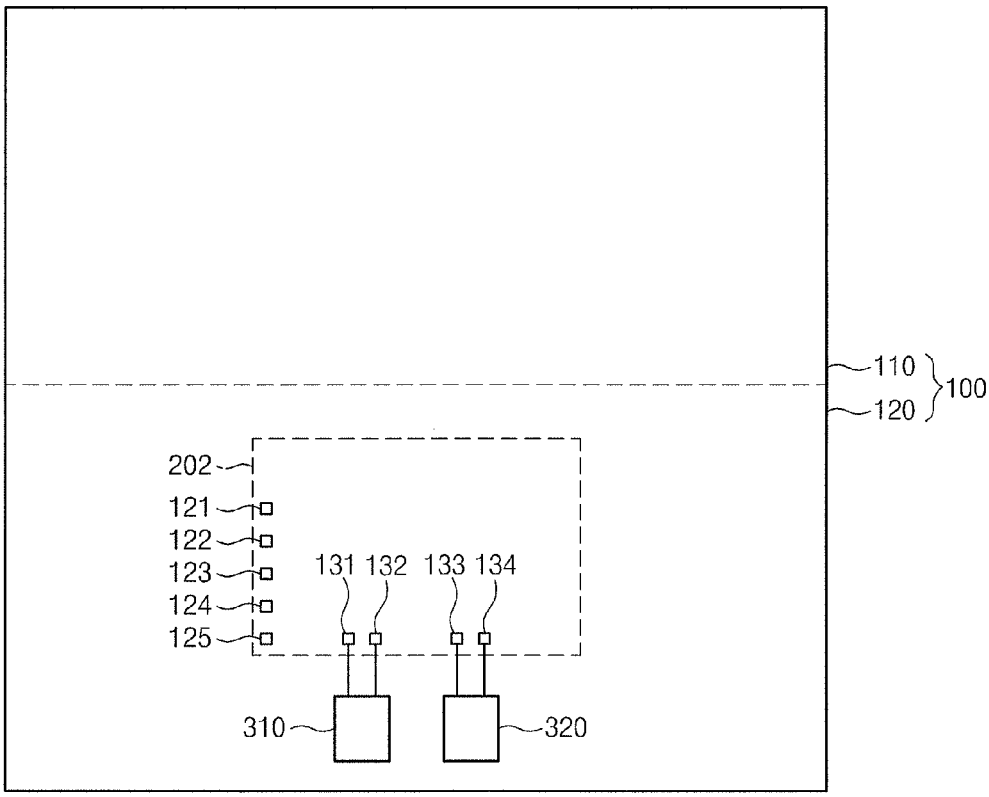
FIG. 2A is a plan view of the display panel illustrated in FIG. 1.
Figure 2B:
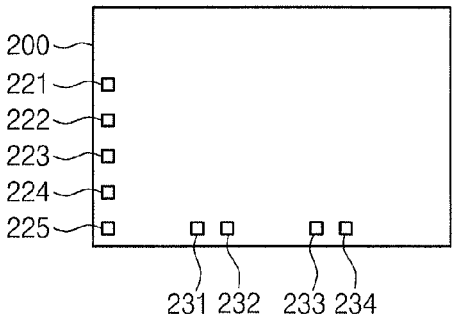
FIG. 2B is a rear view of the driving circuit illustrated in FIG. 1.

FIG. 1 is a plan view illustrating a display device according to an embodiment, FIG. 2A is an enlarged top view of the display panel in FIG. 1, and FIG. 2B is a bottom view of the driving circuit in FIG. 1.

Referring to FIGS. 1 and 2A-2B, the display device according to embodiments may include a display panel 100 and a driving circuit 200. The display panel 100 may include a display area 110 in which pixels are arranged to substantially display an image, and a non-display area 120 in which an image is not displayed, e.g., pixels may not be included in the non-display area 120.

Referring to FIGS. 1 and 2A, the non-display area 120 may include a mounting area 202 where the driving circuit 200 is mounted. First and second delay circuits 310 and 320 may be arranged on the non-display area 120 adjacent to the mounting area 202. The first and second delay circuits 310 and 320 may delay input signals. Main pads 121 to 125 and contact pads 131 to 134 may be disposed on the mounting area 202. The main pads 121 to 125 may include first through fifth main pads 121 to 125 disposed in a column along a side of the mounting area 202. The contact pads 131 to 134 may include first through fourth contact pads 131 to 134 disposed in a row along another side of the mounting area 202. The first and second contact pads 131 and 132 may be connected to the first delay circuit 310. The third and fourth contact pads 133 and 134 may be connected to the second delay circuit 320.

Referring to FIG. 2B, the driving circuit 200 may include first through fifth main bumps 221 to 225 and first through fourth contact bumps 231 to 234. The first through fifth main bumps 221 to 225 may be connected to the first through fifth main pads 121 to 125, respectively. The first through fourth contact bumps 231 to 234 may be connected to the first through fourth contact pads 131 to 134, respectively.

The driving circuit 200 may include a memory cell. The first and second delay circuits 310 and 320 prevent data stored in the memory cell from being lost by introduction of external noise to the memory cell, thus reducing malfunction of the driving circuit 200. This will be described in detail with reference to FIG. 3.

Figure 3:
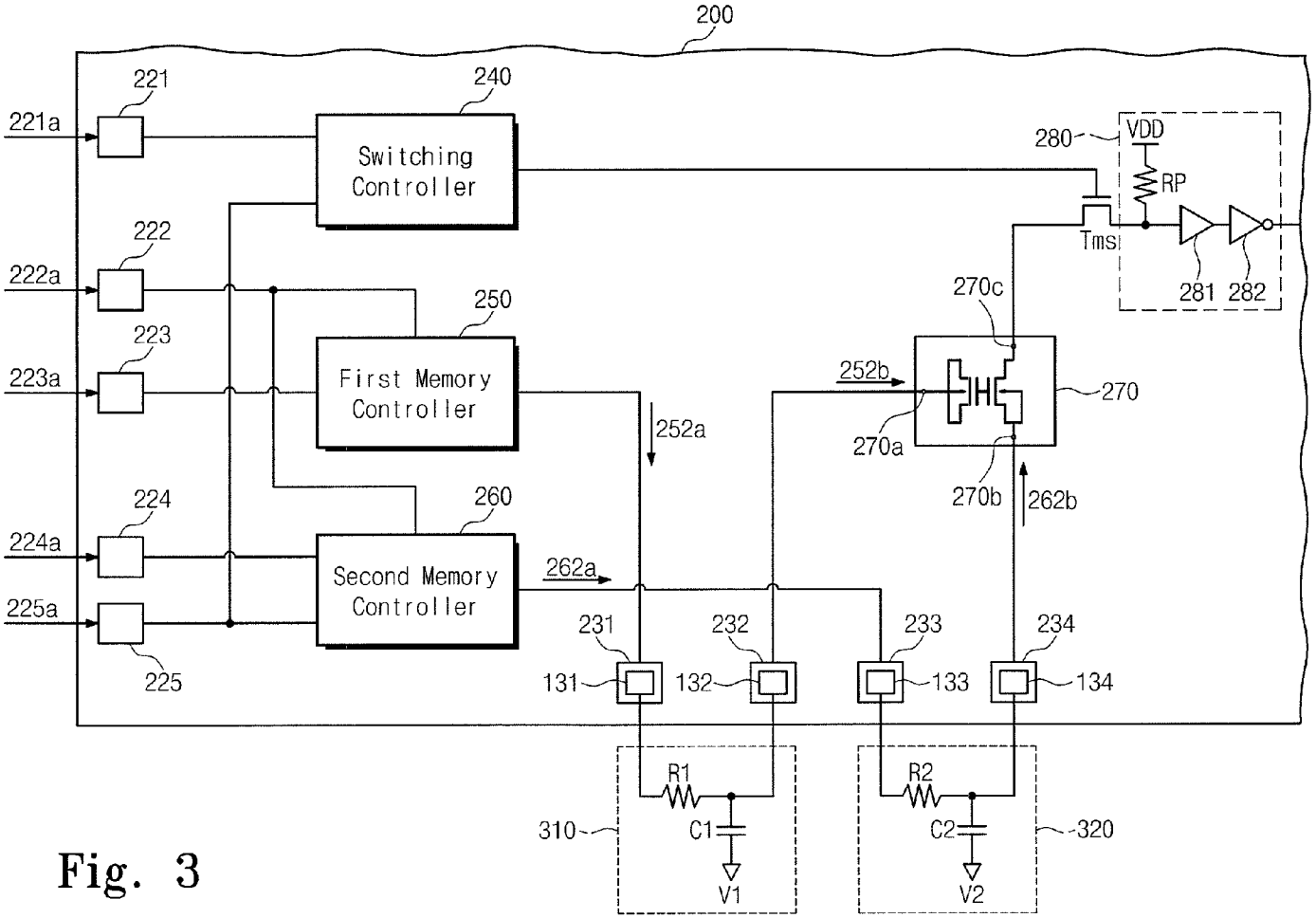
FIG. 3 illustrates a driving circuit and a delay circuit included in a display device according to an embodiment.

FIG. 3 illustrates a driving circuit and a delay circuit included in a display device according to an embodiment. Referring to FIGS. 2A-2B and 3, the driving circuit 200 may include a switching controller 240, a first memory controller 250, a second memory controller 260, a memory cell 270, and an output unit 280.

The first delay circuit 310 may include a first resistor pattern R1 and a first capacitor C1. One end of the first resistor pattern R1 is connected to the first contact bump 231 through the first contact pad 131, and the other end of the first resistor pattern R1 is connected to the second contact bump 232 through the second contact pad 132. One end of the first capacitor C1 may be connected to the other end of the first resistor R1 and the second contact pads 132. A first voltage V1 may be applied to the other end of the first capacitor C1. According to an embodiment, the first voltage V1 may be a ground voltage.

The second delay circuit 320 may include a second resistor pattern R2 and a second capacitor C2. One end of the second resistor pattern R2 is connected to the third contact bump 233 through the third contact pad 133, and the other end of the second resistor pattern R2 is connected to the fourth contact bump 234 through the fourth contact pad 134. One end of the second capacitor C2 may be connected to the other end of the second resistor R2 and the fourth contact pads 134. A second voltage V2 may be applied to the other end of the second capacitor C2. According to an embodiment, the second voltage V2 may have the same level as the first voltage V1.

The switching controller 240 may be connected to the first main bump 221 and the fifth main bump 225. The switching controller 240 may receive a switching control signal 221*a* and a second program control signal 225*a* through the first and fifth main bumps 221 and 225, respectively. The switching controller 240 may turn a memory switching transistor Tms on/off in response to the switching control signal 221*a* and the second program control signal 225*a*.

The first memory controller 250 may be connected to the second main bump 222, the third main bump 223, and the first contact bump 231. The first memory controller 250 may receive a reference voltage signal 222*a* and an erase control signal 223*a* through the second and third main bumps 222 and 223, respectively. The first memory controller 250 may send a first control signal 252*a* to the first contact bump 231 in response to the reference voltage signal 222*a* and the erase control signal 223*a*. The first control signal 252*a* may be transferred to the first delay circuit 310 through the first contact pad 131 connected to the first contact bump 231.

The first control signal 252*a* may be delayed by the first resistor pattern R1 and the first capacitor C1 of the first delay circuit 310, i.e., the first control signal 252*a* may be transformed into a delayed first control signal 252*b* by the first delay circuit 310. The delayed first control signal 252*b* may be transferred to a first control port 270*a* of the memory cell 270, and may control data of the memory cell 270 to be programmed or erased.

The second memory controller 260 may be connected to the second main bump 222, the fourth main bump 224, the fifth main bump 225, and the third contact bump 233. The second memory controller 260 may receive the reference voltage signal 222*a*, a first program control signal 224*a*, and the second program control signal 225*a* through the second, fourth, and fifth main bumps 222, 224 and 225, respectively. The second memory controller 260 may send a second control signal 262*a* to the third contact bump 233 in response to the reference voltage signal 222*a*, the first and second program control signal 224*a* and 225*a*. The second control signal 262*a* may be transferred to the second delay circuit 320 through the third contact pad 133 connected to the third contact bump 233.

The second control signal 262*a* may be delayed by the second resistor pattern R2 and the second capacitor C2 of the second delay circuit 320. The delayed second control signal 262*b* may be transferred to a second control port 270*b* of the memory cell 270, and may control data of the memory cell 270 to be programmed or erased.

Figure 4:
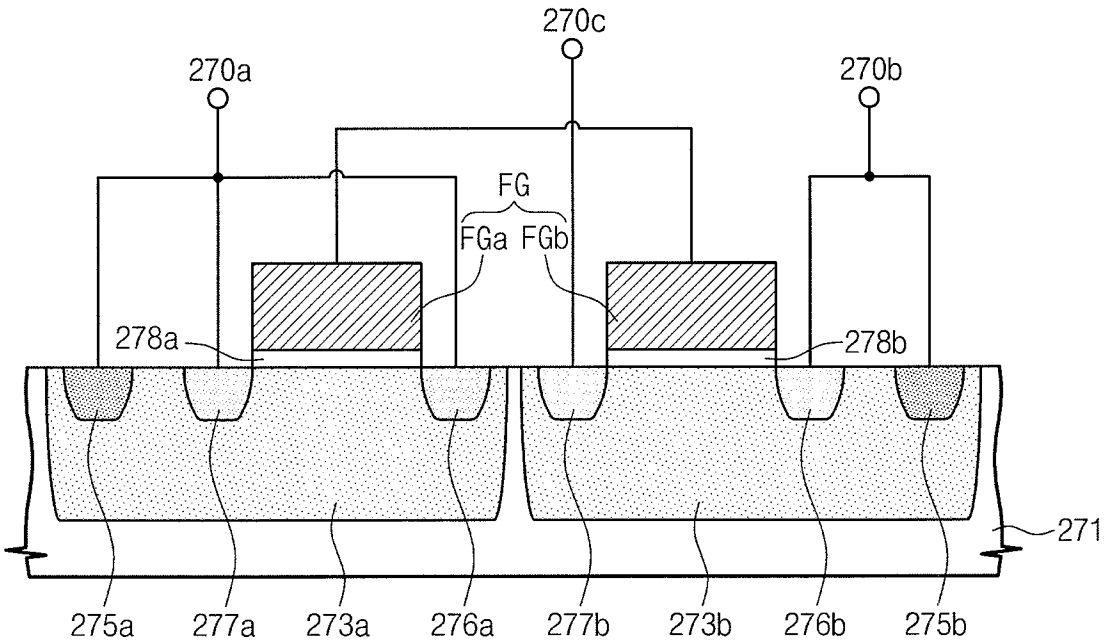
FIG. 4 is a sectional view illustrating a memory cell included in a driving circuit of a display device according to an embodiment.

Data may be programmed into or erased from the memory cell 270 by the delayed first and second control signals 252*b* and 262*b*, as will be described with further reference to FIG. 4. FIG. 4 is a sectional view illustrating a memory cell included in a display device according to an embodiment.

Referring to FIGS. 3 and 4, the memory cell 270 may include a substrate 271 including first and second well regions 273*a* and 273*b*. The substrate 271 is doped with a first conductive type dopant, and the first and second well regions 273*a* and 273*b* may be doped with a second conductive type dopant. The first and second well regions 273*a* and 273*b* may be spaced apart from each other.

First and second memory gate dielectrics 278*a* and 278*b* may be disposed on the first and second well regions 273*a* and 273*b*, respectively. First and second floating gates FGa and FGb may be disposed on the first and second memory gate dielectrics 278*a* and 278*b*, respectively. The first and second floating gates FGa and FGb may be electrically connected to each other.

First source/drain regions 276*a* and 277*a* may be disposed in the first well region 273*a* at both sides of the first floating gate FGa. Second source/drain regions 276*b* and 277*b* may be disposed in the second well region 273*b* at both sides of the second floating gate FGb. The first and second source/drain regions 276*a*, 276*b*, 277*a*, and 277*b* may be regions where the first and second well regions 273*a* and 273*b* are doped with the first conductive type dopant.

A first pickup region 275*a*, which is spaced apart from the first source/drain regions 276*a* and 277*a*, may be disposed in the first well region 273*a*. A second pickup region 275*b*, which is spaced apart from the second source/drain regions 276*b* and 277*b*, may be disposed in the second well region 273*b*. The second conductive type dopant in the first and second pickup regions 275*a* and 275*b* may be higher in concentration than the second conductive type dopant in the first and second well regions 273*a* and 273*b*.

The first control port 270*a* may be connected to the first pickup region 275*a* and the first source/drain region 276*a* and 277*a*. The second control port 270*b* may be connected to the second pickup region 275*b* and the second source region 276*b*. An output port 270*c* may be connected to the second drain region 277*b*.

For example, when the delayed first control signal 252*b* has a high voltage level and the second control signal 262*b* has a low voltage level, data of the memory cell 270 may be erased by injecting carriers (electrons or holes) from the second well region 273*b* of the memory cell 270 to the floating gates FGA and FGb. In another example, when the delayed first control signal 252*b* has a low voltage level and the second control signal 262*b* has a high voltage level, data may be programmed to the memory cell 270 by transferring carriers (electrons or holes) stored in the floating gate FG of the memory cell 270 to the second well region 273*b*.

According to embodiments, even if external noise is applied to the bumps 221 to 225 and 231 to 234, and/or the pads 131 to 134, signals may be input to the first and second control ports 270*a* and 270*b* by the delay circuits 310 and 320 at the same time. According to an embodiment, the signals, which are input to the first and second control ports 270*a* and 270*b*, may be due to the external noise applied to the bumps 221 to 225 and 231 to 234 and/or the pads 131 to 134. According to another embodiment, the signals, which are input to the first and second control ports 270*a* and 270*b*, may be the delayed first and second control signals 252*b* and 262*b*. As a result, malfunction of the driving circuit 200 can be prevented because data stored in the memory cell 270 can be prevented from being lost by the external noise.

Conventionally, when a signal is inadvertently input to a control port, e.g., due to an external noise, data stored in a floating gate of a memory cell may be lost and/or modified in accordance with the inadvertently input signal. In this case, the reliability of a display device may be reduced by malfunction of the driving circuit.

However, according to example embodiments, the first and second delay circuits 310 and 320 may prevent the data stored in the memory cell 270 from being lost or modified due to noise, so that malfunction of the driving circuit 200 is reduced. Therefore, a highly reliable display device may be provided.

In the drawing, although the first and second delay circuits 310 and 320, which are connected to the respective first and second control ports 270*a* and 270*b*, are illustrated, one of the first and second delay circuits 310 and 320 may be omitted.

For example, the first control signal 252*a*, e.g., generated by external noise, may be applied to the memory cell 270 through the first delay circuit 310, i.e., connected to the first control port 270*a*, and the second delay circuit 320 may be omitted. In another example, when the second control signal 262*a* is first applied to the memory cell 270 by the external noise, i.e., rather than the first control signal 252*a*, the second delay circuit 320 may be connected to the second control port 270*b*, and the first delay circuit 310 may be omitted.

The output port 270*c* of the memory cell 270 may be connected to a source of the memory switching transistor Tms. When the memory switching transistor Tms, which is controlled by the switching controller 240, is turned on, data stored in the memory cell 270 may be transferred to the outside via the output unit 280.

The output unit 280 may include a pull-up resistor RP, an amplifier 281, and an inverter 282. Pull-up voltage (VDD) is applied to one end of the pull-up resistor RP, and the other end of the pull-up resistor RP may be connected to the amplifier 281. The amplifier 281 and the inverter 282 may be serially connected.

Figure 5:
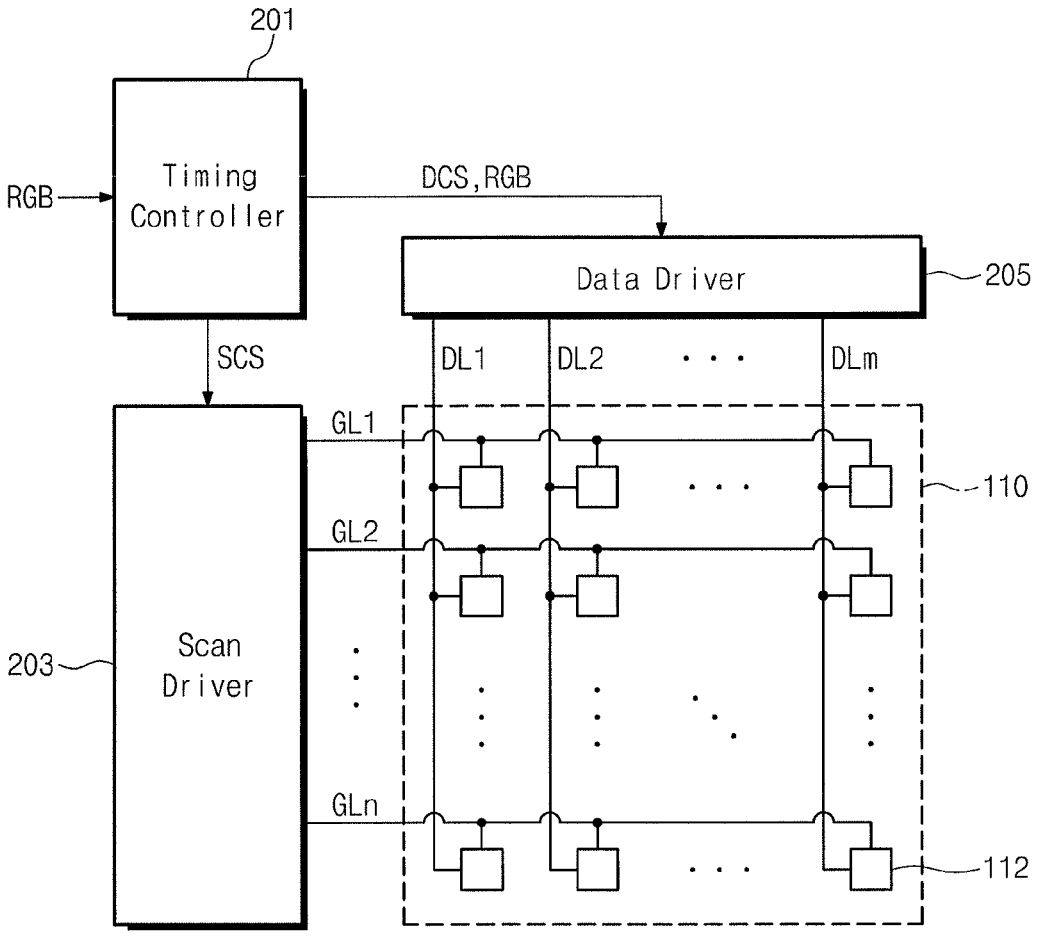
FIG. 5 is a circuit diagram illustrating a display panel and a driving circuit included in a display device according to an embodiment.

The driving circuit 200 may further include circuits that drive pixels which are directly integrated in the display panel through a thin film process, as will be described with reference to FIG. 5. FIG. 5 is a circuit diagram illustrating a display panel and a driving circuit included in a display device according to an embodiment.

Referring to FIG. 5, the driving circuit 200 may include a timing controller 201, a scan driver 203, and a data driver 205. It is noted that the driving circuit 200 in FIG. 5 is the same driving circuit 200 described previously with reference to FIGS. 1 and 2B.

The timing controller 201 may generate a scan control signal SCS, and a data control signal DCS. The timing controller 201 may generate and transfer the scan control signal SCS to the scan driver 203, and also generate and transfer the data control signal DCS to the data driver 205. Furthermore, the timing controller 201 may receive pixel data signals RGB and transfer the received pixel data signals RGB to the data driver 205.

The display panel 110 may include a plurality of gate lines GL1 to GLn extending in a first direction, a plurality of data lines DL1 to DLm extending in a second direction perpendicular to the first direction, and a plurality of pixels 112. Each of the pixels 112 may be connected to one gate line and one data line. The plurality of pixels 112 extending in the first direction may constitute a row, and the plurality of pixels 112 extending in the second direction may constitute a column. The pixels 112 included in the same row may be connected to the same gate line, and the pixels 112 included in the same column may be connected to the same data line. The gate lines GL1 to GLn may be extended between the adjacent rows, and the data lines DL1 to DLm may be extended between the columns.

The scan driver 203 receives the scan control signal SCS, and may sequentially apply gate voltage to the plurality of gate lines GL1 to GLn in response to the scan control signal SCS.

Switching transistors, which are included in the pixels connected to the selected gate lines in which the gate voltage is applied among the plurality of gate lines GL1 to GLn, may be turned on. Switching transistors, which are included in the pixels connected to non-selected gate lines in which the gate voltage is not applied, may be turned off. Transistors, which are included in the pixels connected to the same gate lines, may be turned on or turned off at the same time.

The data driver 205 may receive the pixel data signals RGB and the data voltage control signal DCS. The data driver 205 may convert the gradated pixel data signal RGB into an analog voltage and supply a data output voltage to the data lines DL1 to DLm.

Figure 6A:
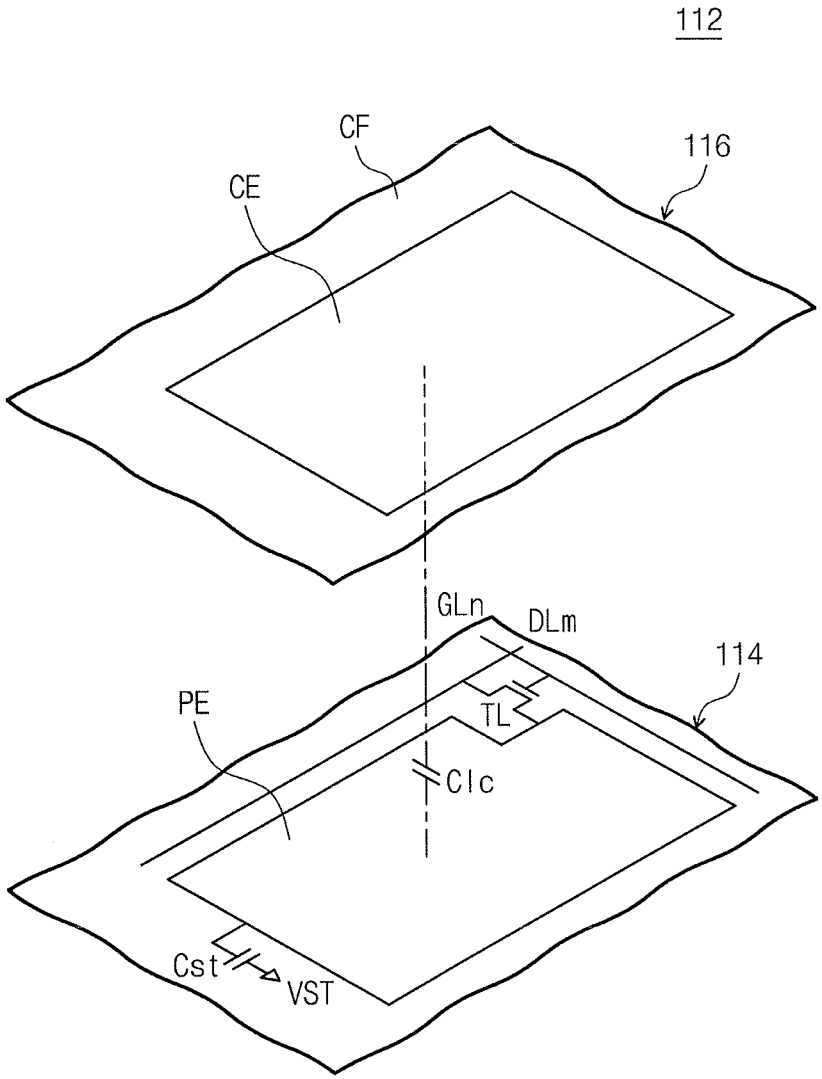
FIG. 6A is a schematic view illustrating a pixel included in a display device according to an embodiment.

For example, the display panel 110 may be a liquid crystal display panel including liquid crystal pixels, as will be described with reference to FIG. 6A. FIG. 6A is a schematic view illustrating a pixel included in a display device according to an embodiment of the inventive concept, and exemplarily illustrates one of the pixels 112 of the display panel 110 shown in FIG. 5. For simplicity of the description, a pixel connected to nth gate line GLn and mth data line DLm is illustrated.

Referring to FIGS. 5 and 6A, the display panel 110 may include a first substrate structure 114 with the plurality of gate lines GL1 to GLn and the plurality of data lines DL1 to DLm, a second substrate structure 116 facing the first substrate structure 114, and a liquid crystal layer (not shown) disposed between the first substrate structure 114 and the second substrate structure 116.

Each of the pixels 112 may include a transistor TL connected to the mth data line Dm, a liquid crystal capacitor Clc, and a storage capacitor Cst. The liquid crystal capacitor Clc and storage capacitor Cst are connected to the transistor TL.

In the switching transistor TL, for example, a control port is connected to the nth gate line GLn, an input port is connected to the mth data line DLm, and an output port may be connected to the liquid crystal capacitor Clc and the storage capacitor Cst. The liquid crystal capacitor Clc may be formed by using a pixel electrode PE of the first substrate structure 114 and a common electrode CE of the second substrate structure 116 as two terminals, and using the liquid crystal layer (not shown) disposed between the pixel electrode PE and the common electrode CE acts as a dielectric. The pixel electrode PE is connected to the switching transistor TL, and the common electrode CE is formed on an entire surface of the second substrate structure 116, thus receiving a common voltage.

The storage capacitor Cst may include a lower electrode on the first substrate structure 114, an upper electrode disposed on the lower electrode and connected to the pixel electrode PE, and an insulator between the lower and upper electrodes. A storage voltage Vst, which is the same level as the common voltage, may be applied to the lower electrode.

Each of the pixels 112 may display one color of red, green, and blue. A color filter CF, which is for displaying any one of the red, green, and blue colors, may be included in a certain region of the second substrate structure 116 corresponding to the pixel electrode PE.

The liquid crystal layer between the pixel electrode PE and the common electrode CE may be driven by a difference between the data output voltage applied to the pixel electrode PE of the liquid crystal capacitor Clc and the common voltage applied to the common electrode CE. Therefore, gray-scale values of the pixels 112 may be controlled.

Figure 6B:
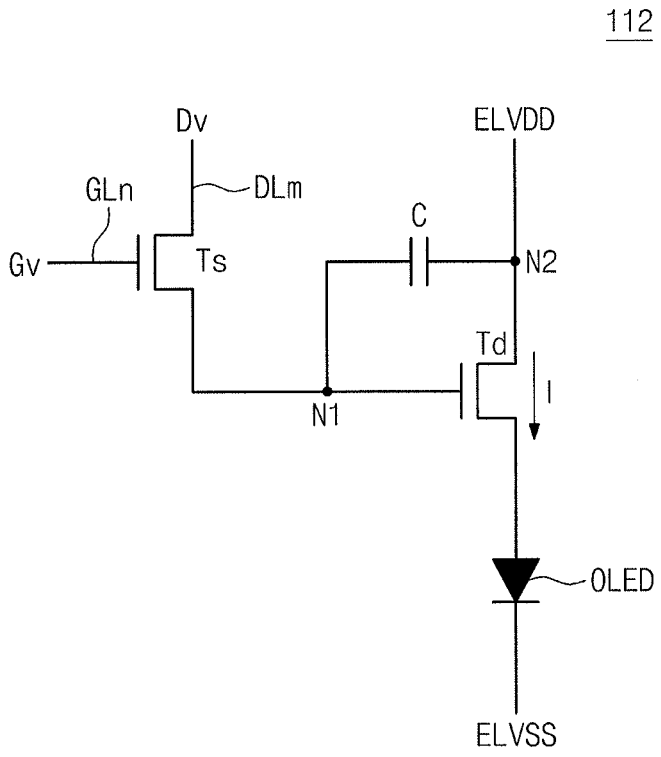
FIG. 6B is a circuit diagram illustrating a pixel included in a display device according to another embodiment.

In another example, the display panel 110 may be an organic light emitting display panel including an organic light emitting diode, as will be described with reference to FIG. 6B. FIG. 6B is a circuit diagram illustrating a pixel included in a display device according to another embodiment, which exemplarily illustrates one of the pixels 112 of the display panel 110 shown in FIG. 5. For simplicity of the description, a pixel connected to the nth gate line GLn and the mth data line DLm is illustrated.

Referring to FIGS. 5 and 6B, the pixels 112 may include a switching device, a storage device, and a light emitting device. The switching device may include a switching transistor Ts and a drive transistor Td, the storage device may be a capacitor C, and the light emitting device may be an organic light emitting diode (OLED).

The pixels 112 may display one color of blue, green, and red. A pixel presenting the blue color, a pixel presenting the green color, and a pixel presenting the red color may constitute one group, and the groups are repeatedly arranged in the first and second directions. Also, a pixel presenting white color may be further included in the group and then the groups are repeatedly arranged in the first and second directions.

The nth gate line GLn may apply a gate voltage Gv supplied from the scan driver 203 to the pixel 112. The mth data line DLm may apply a data output voltage Dv supplied from the data driver 205 to the pixel 112.

The switching transistor Ts may be connected between the mth data line DLm and a first node N1. The switching transistor Ts may transfer the data output voltage Dv applied through the mth data line DLm to the first node N1 by being turned on by the gate voltage Gv applied through the nth gate line GLn. The data output voltage Dv transferred to the first node N1 may be stored in the storage capacitor C connected between the first node N1 and a second node N2.

The drive transistor Td may be turned on by the data output voltage Dv transferred to the first node N1. When the drive transistor Td is turned on and a voltage difference between a first light emitting power source ELVDD and a second light emitting power source ELVSS is greater than a reference value, a drive current I may be applied to an organic light emitting diode (OLED). When the drive current I is applied to the OLED, the OLED can emit light.

Intensity of the drive current I may be determined by the data output voltage Dv applied to the drive transistor Td. Brightness of the OLED may be proportional to the intensity of the drive current I. Therefore, the brightness of the OLED may be determined by the data output voltage Dv.

The resistor patterns R1 and R2 and the capacitors C1 and C2, which are included in the delay circuits 310 and 320 described with reference to FIG. 3, may be provided with the same processes as the switching transistor TL included in the pixel described with reference to FIG. 6A, or the switching transistor Ts and/or the drive transistor Td included in the pixel described with reference to FIG. 6B. This will be described with reference to FIGS. 7A and 7B.

Figure 7A:
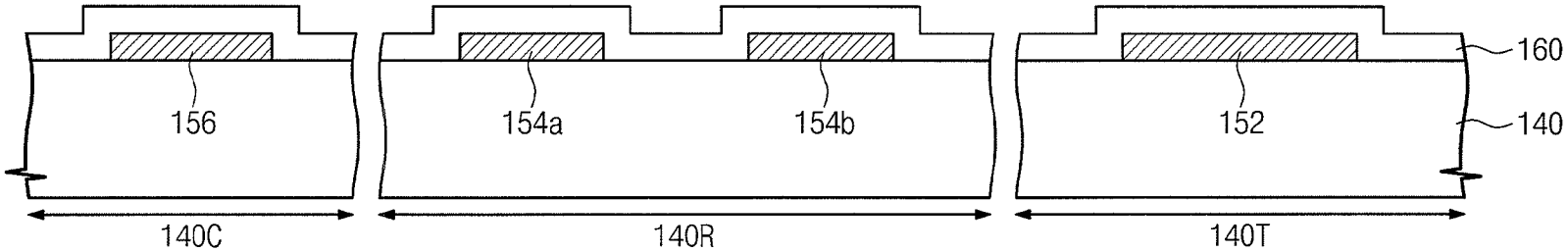
FIGS. 7A and 7B are sectional views illustrating a forming method of a delay circuit included in a display device and a transistor included in a pixel according to an embodiment.
Figure 7B:
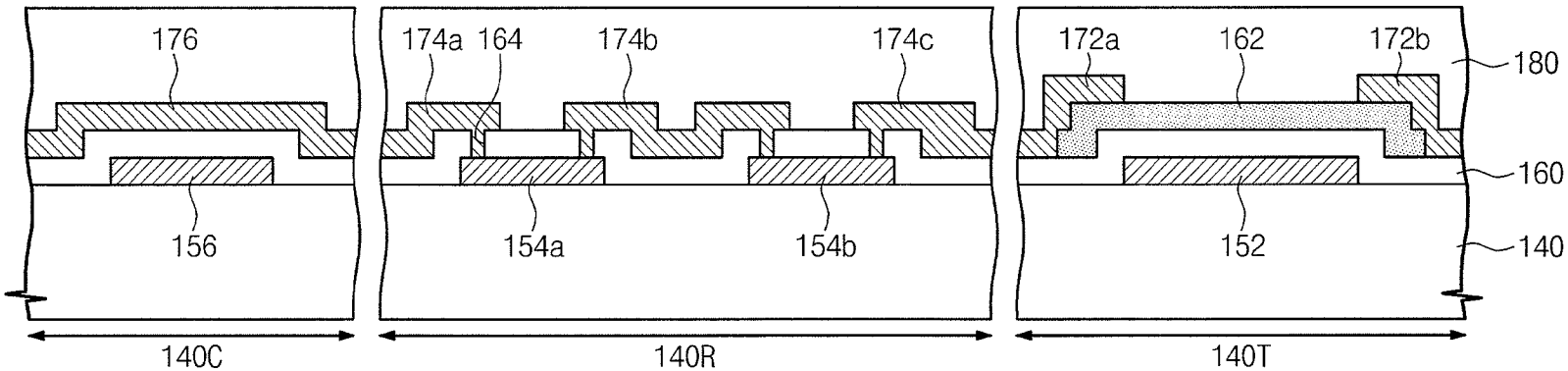

FIGS. 7A and 7B are sectional views illustrating a method of forming a delay circuit included in a display device and a transistor included in a pixel according to an embodiment.

Referring to FIG. 7A, a substrate 140 including a transistor area 140T, a resistor area 140R, and a capacitor area 140C is provided. The transistor area 140T may be a region where the transistors, which are included in the pixels described with reference to FIGS. 6A and 6B, are formed. The resistor area 140R may be a region where the resistor patterns R1 and R2, which are included in the delayed circuits 310 and 320 described with reference to FIG. 3, are formed. The capacitor area 140C may be a region where the capacitors C1 and C2, which are included in the delayed circuits 310 and 320 described with reference to FIG. 3, are formed.

A first material layer may be formed on an entire surface of the substrate 140. By patterning the first material layer, a gate electrode pattern 152 is formed on the transistor area 140T, first and second resistor patterns 154*a* and 154*b* are formed on the resistor area 140R, and a lower electrode 156 may be formed on the capacitor area 140C. The first and second resistor patterns 154*a* and 154*b* may be spaced apart from each other. The gate electrode pattern 152, the first and second resistor patterns 154*a* and 154*b*, and the lower electrode 156 are provided in the same process, may be formed of the same material, and may be at a same distance from the substrate 140. For example, the first material layer may include at least one of molybdenum (Mo), aluminum (Al), niobium (Nb), silver (Ag), copper (Cu), chromium (Cr), titanium (Ti), or tantalum (Ta). It is noted that a distance of an element from the substrate 140 refers to a distance measured from a major lowest surface of the element, i.e., a surface of the element facing the substrate 140, to a lowest surface of the substrate 140, i.e., a bottom surface of the substrate 140 supporting the substrate 140, along a normal to the bottom surface of the substrate 140.

After patterning the first material layer, a dielectric layer 160 may be formed on the entire surface of the substrate 140. The dielectric layer 160 may cover the gate electrode pattern 152, the first and second resistor patterns 154*a* and 154*b*, and the lower electrode 156. The dielectric layer 160 may include at least one of a silicon nitride layer, a silicon oxide layer, or a silicon oxynitride layer.

Referring to FIG. 7B, a semiconductor pattern 162 that covers the gate electrode pattern 152 may be formed on the transistor area 140T. The semiconductor pattern 162 may include amorphous or crystalline silicon. A second material layer may be formed on the entire surface of the substrate 140. Before forming the second material layer, openings 164 may be formed to expose both ends of the first and second lower resistor patterns 154*a* and 154*b*. The second material layer may be formed to fill the openings 164.

By patterning the second material layer, source and drain electrodes 172*a* and 172*b* are formed on the transistor area 140T, upper resistor patterns 174*a*, 174*b* and 174*c* are formed on the resistor area 140R, and an upper electrode 176 may be formed on the capacitor area 140C. The source and drain electrodes 172*a* and 172*b* may cover the semiconductor pattern 162 at both sides of the gate electrode pattern 152. The first upper resistor pattern 174*a* may be connected to one end of the first lower resistor pattern 154*a* by penetrating the dielectric layer 160. The second upper resistor pattern 174*b* may be connected to the other end of the first lower resistor pattern 154*a* and one end of the second lower resistor pattern 154*b* by penetrating the dielectric layer 160. The third upper resistor pattern 174*c* may be connected to the other end of the second lower resistor pattern 154*b* by penetrating the dielectric layer 160. The upper electrode 176 may be overlapped with the lower electrode 156.

The source and drain electrodes 172*a* and 172*b*, the upper resistor patterns 174*a*, 174*b* and 174*c*, and the upper electrode 176 are provided in the same process, and may be formed of the same material. For example, the second material layer may include at least one of molybdenum (Mo), aluminum (Al), tungsten (W), vanadium (V), chromium (Cr), tantalum (Ta), or titanium (Ti).

A portion of the dielectric layer 160 disposed between the gate electrode pattern 152 and the semiconductor pattern 162 may be defined as a gate dielectric layer. A portion of the dielectric layer 160 covering the lower resistor patterns 154*a* and 154*b* may be defined as a resistor pattern dielectric layer. A portion of the dielectric layer 160 between the lower electrode 156 and the upper electrode 176 may be defined as a capacitor dielectric layer.

After forming the source and drain electrodes 172*a* and 172*b*, the upper resistor patterns 174*a*, 174*b* and 174*c*, and the upper electrode 176, an interlayer dielectric 180 may be formed on the entire surface of the substrate 140. The interlayer dielectric 180 may include at least one of a silicon oxide layer, a silicon nitride layer, a silicon oxynitride layer, or an organic layer.

The gate electrode pattern 152, the gate dielectric layer, the semiconductor pattern 162, and the source and drain electrodes 172*a* and 172*b* may be included in the transistors of the pixels described with reference to FIGS. 6A and 6B. The lower resistor patterns 154*a* and 154*b*, the resistor pattern dielectric layer, and the upper resistor patterns 174*a*, 174*b* and 174*c* may be included in the resistor patterns R1 and R2 of the delayed circuits 310 and 320 described with reference to FIG. 3. The lower electrode 156, the capacitor dielectric layer, and the upper electrode 176 may be included in the capacitors C1 and C2 of the delayed circuits 310 and 320 described with reference to FIG. 3.

In the foregoing embodiments, the semiconductor pattern 162 is formed on the gate electrode pattern 152. Alternatively, the gate electrode pattern may be formed on the semiconductor pattern, as will be described with reference to FIGS. 8A and 8B.

Figure 8A:
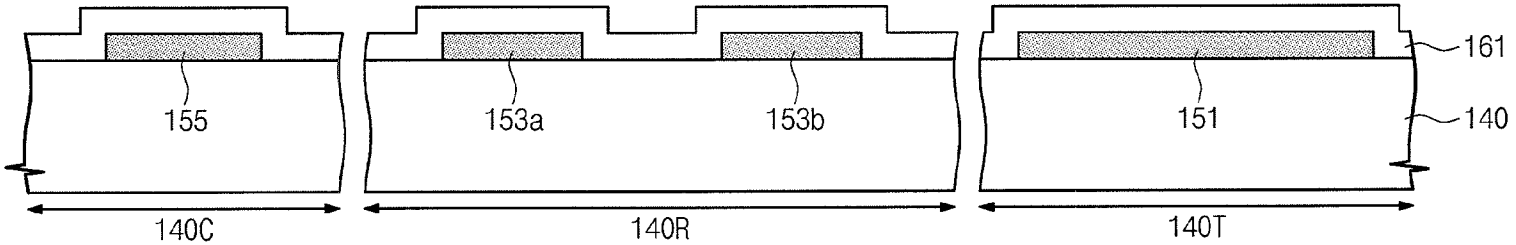
FIGS. 8A and 8B are sectional views illustrating a method of forming a delay circuit included in a display device and a transistor included in a pixel according to a modified example of the embodiment.
Figure 8B:
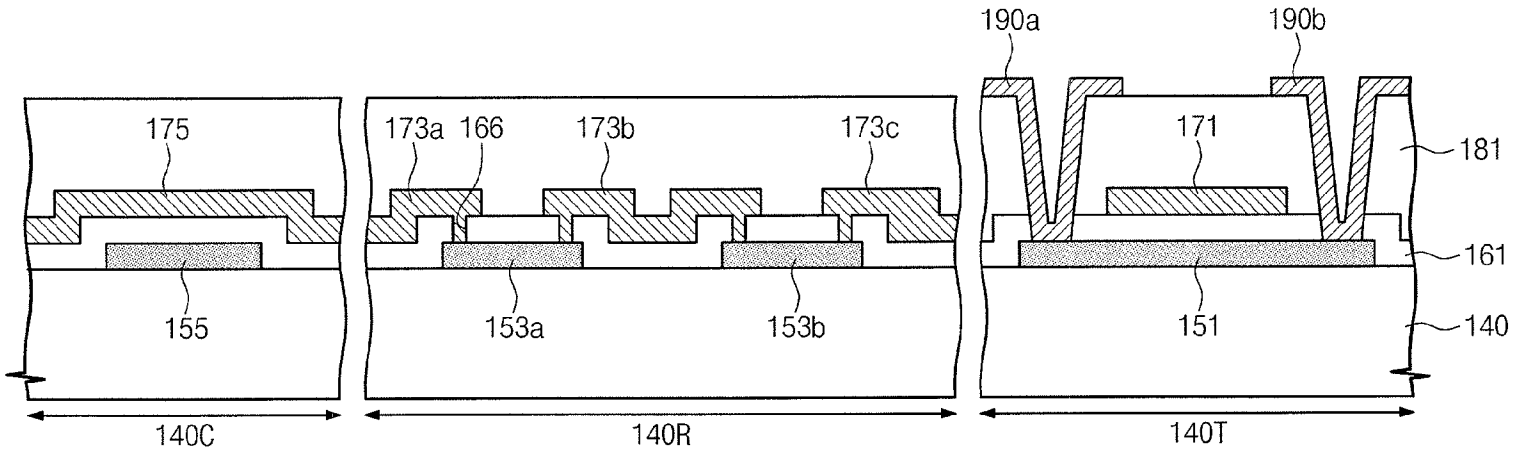

FIGS. 8A and 8B are sectional views illustrating a method of forming a delay circuit included in a display device and a transistor included in a pixel according to a modified example of an embodiment. Referring to FIG. 8A, as described with reference to FIG. 7A, the substrate 140 including the transistor area 140T, the resistor area 140R, and the capacitor area 140C is provided.

A third material layer may be formed on an entire surface of the substrate 140. By patterning the third material layer, a semiconductor pattern 151 is formed on the transistor area 140T, first and second resistor patterns 153*a* and 153*b* are formed on the resistor area 140R, and a lower electrode 155 may be formed on the capacitor area 140C. The first and second resistor patterns 153*a* and 153*b* may be spaced apart from each other. The semiconductor pattern 151, the first and second resistor patterns 153*a* and 153*b*, and the lower electrode 155 are provided in the same process to each other, and may be formed of the same material to each other. For example, the third material layer may be formed of a semiconductor material. The semiconductor material may include amorphous or crystalline silicon.

After patterning the third material layer, a dielectric layer 161 may be formed on the entire surface of the substrate 140. The dielectric layer 161 may cover the semiconductor pattern 151, the first and second resistor patterns 153*a* and 153*b*, and the lower electrode 155. The dielectric layer 161 may include the same material as the dielectric layer 160 described with reference to FIG. 7A.

Referring to FIG. 8B, the dielectric layer 161 may be patterned to form openings 166 exposing both ends of the first and second lower resistor patterns 153*a* and 153*b*. A fourth material layer may be formed on the entire surface of the substrate 140. The fourth material layer may be formed on the dielectric layer 161. The fourth material layer may be formed to fill the openings 166. By patterning the fourth material layer, a gate electrode pattern 171 is formed on the transistor area 140T, upper resistor patterns 173*a*, 173*b* and 173*c* are formed on the resistor area 140R, and an upper electrode 175 may be formed on the capacitor area 140C.

The gate electrode pattern 171 may be overlapped with the semiconductor pattern 151. The first upper resistor pattern 173*a* may be connected to one end of the first lower resistor pattern 153*a* by penetrating the dielectric layer 161. The second upper resistor pattern 173*b* may be connected to the other end of the first lower resistor pattern 153*a* and one end of the second lower resistor pattern 153*b* by penetrating the dielectric layer 161. The third upper resistor pattern 173*c* may be connected to the other end of the second lower resistor pattern 153*b* by penetrating the dielectric layer 161. The upper electrode 175 may be overlapped with the lower electrode 155.

The gate electrode pattern 171, the upper resistor patterns 173*a*, 173*b* and 173*c*, and the upper electrode 175 are provided in the same process to each other, and may be formed of the same material to each other. For example, the fourth material layer may include the same material as the second material layer described with reference to FIG. 7B.

A portion of the dielectric layer 161 disposed between the gate electrode pattern 171 and the semiconductor pattern 151 may be defined as a gate dielectric layer. A portion of the dielectric layer 161 covering the lower resistor patterns 153*a* and 153*b* may be defined as a resistor pattern dielectric layer. A portion of the dielectric layer 161 between the lower electrode 155 and the upper electrode 175 may be defined as a capacitor dielectric layer.

After forming the gate electrode pattern 171, the upper resistor patterns 173*a*, 173*b* and 173*c*, and the upper electrode 175, an interlayer dielectric 181 may be formed on the entire surface of the substrate 140. The interlayer dielectric 181 may include the same material as the interlayer dielectric 180 described with reference to FIG. 7B.

Source and drain electrodes 190*a* and 190*b*, which are in contact with the semiconductor pattern 151 at both sides of the gate electrode pattern 171, may be formed by penetrating the interlayer dielectric 181 and the dielectric layer 161.

According to an embodiment, the gate electrode pattern 171, the gate dielectric layer, the semiconductor pattern 151, and the source and drain electrodes 190*a* and 190*b* may be included in the transistors which are included in the pixels described with reference to FIGS. 6A and 6B. The lower resistor patterns 153*a* and 153*b*, the resistor pattern dielectric layer, and the upper resistor patterns 173*a*, 173*b* and 173*c* may be included in the resistor patterns R1 and R2 which are included in the delayed circuits 310 and 320 described with reference to FIG. 3. The lower electrode 155, the capacitor dielectric layer, and the upper electrode 175 may be included in the capacitors C1 and C2 which are included in the delayed circuits 310 and 320 described with reference to FIG. 3.

According to embodiments, a driving circuit for driving pixels of a display panel may include a memory cell. The display panel may be connected to the memory cell, and may include a delay circuit that delays a signal input to the memory cell. As a result, data loss and/or modification of the memory cell caused by external noise may be prevented or substantially minimized, so that malfunction of the driving circuit may be prevented, e.g., an electrostatic protection circuit may be improved. Therefore, a highly reliable display device may be provided. In contrast, when external noise, e.g., static electricity, is applied to a driving circuit driving a conventional display panel, i.e., a display device without the delay circuits, the operational reliability of the display panel may be deteriorated.

While the inventive concept has been particularly shown and described with reference to exemplary embodiments thereof, it will be understood by those of ordinary skill in the art that various changes in form and details may be made therein without departing from the spirit and scope of the inventive concept as defined by the following claims. Therefore, the above-disclosed subject matter is to be considered illustrative and not restrictive.

What is claimed is:

1. A display device, comprising:

a display panel including a display area, in which pixels are arranged, and a non-display area;

a driving circuit on the non-display area of the display panel, the driving circuit being configured to drive the pixels and including a memory cell, the memory cell receiving a first control signal and a second control signal; and a delay circuit on the non-display area of the display panel, the delay circuit being connected to the memory cell of the driving circuit and being configured to delay at least one of the first and second control signals to the memory cell of the driving circuit to provide the first and second control signal to the driving circuit at the same time, wherein programming and erasing of the memory cell is controlled by combinations of the first and second control signals, wherein each of the pixels includes a transistor containing a gate electrode on a substrate, a gate dielectric layer, a semiconductor pattern, and source/drain electrodes, wherein the delay circuit includes a resistor pattern and a capacitor, wherein the resistor pattern includes a lower resistor pattern, a resistor pattern dielectric layer on the lower resistor pattern, and an upper resistor pattern on the resistor pattern dielectric layer, and wherein the capacitor includes a lower electrode, a capacitor dielectric layer on the lower electrode, and an upper electrode on the capacitor dielectric layer.

2. The display device of claim 1, wherein the memory cell includes first and second control ports, the first and second control ports being configured to receive the first and second control signals respectively.

3. The display device of claim 2, wherein the driving circuit further comprises a first memory controller transferring the first control signal to the first control port, and a second memory controller transferring the second control signal to the second control port.

4. The display device of claim 3, wherein the delay circuit includes a first delay circuit connected to the first control port and a second delay circuit connected to the second control port, the first and second control signals being input to the first and second control ports through the first and second delay circuits, respectively.

5. The display device of claim 2, wherein the memory cell further comprises an output port through which data of the memory cell is output, the driving circuit further comprising a switch connected to the output port and a switch controller configured to control the switch.

6. The display device of claim 1, wherein the display panel further comprises a contact pad connected to the delay circuit, and the driving circuit further comprises a contact bump connected to the memory cell, the contact bump and the contact pad being electrically connected.

7. The display device of claim 6, wherein the memory cell includes:

a substrate with first and second well regions, the first and second well regions having first and second pickup regions, respectively; and first and second control ports connected to the first and second pickup regions, respectively.

8. The display device of claim 7, wherein:

the driving circuit further comprises a first memory controller generating signals controlling the programming and erasing of the memory cell, the contact bump includes a first contact bump connected to the first memory controller and a second contact bump connected to the first control port, and the contact pad includes first and second contact pads connected to the delay circuit, the first and second contact pads being connected to the first and second contact bumps, respectively.

9. The display device of claim 8, wherein:

the driving circuit further comprises a second memory controller generating the signals controlling the programming and erasing of the memory cell, the contact bumps further comprise a third contact bump connected to the second memory controller and a fourth contact bump connected to the second control port, the contact pads further comprise third and fourth contact pads, the delay circuit comprises a first delay circuit connected to the first and second contact pads and a second delay circuit connected to the third and fourth contact pads, and the third and fourth contact pads are connected to the third and fourth contact bumps, respectively.

10. The display device of claim 9, wherein the memory cell further comprises:

first and second floating gates disposed on the first and second well regions, respectively, and connected to each other;

first source and drain regions disposed in the first well region at both sides of the first floating gate, the first control port being connected to the first source region; and second source and drain regions disposed in the second well region at both sides of the second floating gate, the second control port being connected to the second source and drain regions.

11. The display device of claim 1, wherein the gate electrode and the lower resistor pattern are at a same distance from the substrate, the gate dielectric layer and the resistor pattern dielectric layer are at a same distance from the substrate, and the source/drain electrodes and the upper resistor pattern are at a same distance from the substrate.

12. The display device of claim 11, wherein the lower electrode and the gate electrode are at a same distance from the substrate, the capacitor dielectric layer and the gate dielectric layer are at a same distance from the substrate, and the upper electrode and the source/drain electrodes are at a same distance from the substrate.

13. The display device of claim 1, wherein the semiconductor pattern, the lower resistor pattern, and the lower electrode are at a same distance from the substrate, the gate dielectric layer, the resistor pattern dielectric layer, and the capacitor dielectric layer are at a same distance from the substrate, and the gate electrode, the upper resistor pattern, and the upper electrode are at a same distance from the substrate.

14. The display device of claim 1, wherein the lower resistor pattern includes first and second lower resistor patterns spaced apart from each other, the upper resistor pattern including:

a first upper resistor pattern penetrating the resistor pattern dielectric layer to be connected to one end of the first lower resistor pattern, a second upper resistor pattern penetrating the resistor pattern dielectric layer to be connected to the other end of the first lower resistor pattern and one end of the second lower resistor pattern, and a third upper resistor pattern penetrating the resistor pattern dielectric layer to be connected to the other end of the second lower resistor pattern.

* * * * *